United States Patent [19]

Diaconu et al.

[11] Patent Number: 4,866,414

[45] Date of Patent: Sep. 12, 1989

[54] OPTOELECTRONIC LAWN TENNIS LINESMAN SYSTEM

[76] Inventors: Sever Diaconu; Alen Diaconu, both of P.O. Box 9517, Hickory, N.C. 28603

[21] Appl. No.: 177,105

[22] Filed: Apr. 4, 1988

[51] Int. Cl.[4] ..... G08B 21/00

[52] U.S. Cl. ..... 340/323 R; 273/29 R

[58] Field of Search ..... 340/323 R, 600, 555, 340/567; 273/29 R, 31; 358/108; 364/410, 411; 250/226, 222.1

[56] References Cited

U.S. PATENT DOCUMENTS

| | | | |
|---|---|---|---|
| 2,561,197 | 7/1951 | Goldsmith | 358/108 X |
| 4,004,805 | 1/1977 | Chen et al. | 340/323 R X |
| 4,115,006 | 9/1978 | Reymond et al. | 250/226 X |
| 4,183,056 | 1/1980 | Evans et al. | 340/323 R X |
| 4,232,219 | 11/1980 | Yamamoto et al. | 250/226 X |
| 4,432,058 | 2/1984 | Supran | 340/323 R X |
| 4,528,548 | 7/1985 | Oberan | 340/323 R |

*Primary Examiner*—Joseph A. Orsino
*Assistant Examiner*—Brian R. Tumm
*Attorney, Agent, or Firm*—Steven J. Hultquist; Lynn E. Barber

[57] ABSTRACT

The optical line watchers continuously monitor the out areas along the court lines, selectively capture the images when the ball touches the watched areas, and convert optical information into electrical pulses of current, which properly selected and amplified, produce audio and video announcements.

11 Claims, 2 Drawing Sheets

OPTOELECTRONIC LAWN TENNIS LINESMAN SYSTEM

BACKGROUND OF THE INVENTION

1. The Field of the Invention

This invention relates to LAWN TENNIS, offering an error-free judgement means, on all existent courts, either hard, medium or soft ones, as the classic lawn, using along all lines, the optical watchers in connection with appropriate electronic equipmant, which detects any touch of the ball on the surveyed are, converts this information from optical images into electrical pulses of current and actuates the video and audio announcing systems.

2. Description of the Prior Art

It is already known that the human judgment may commit errors which badly may alter the result of a competition. It is quite usual that one player starts to think that the judge is not fair to him.

The other systems produced until now worked reasonably well but only with the hard, fast courts, mostly used during the indoor competitions. Sometimes the surface appears to be too slippery, that was due to the fibre glass used to cover the playing area. Our system is a universal device which may be used on any sort of court. It can be easily removed and the slight modification produced will not affect the area of play, but only a narrow strip a few inches wide below the net. The court qualities are not to be changed at all. In winter everything can be easily removed and the court used for other purposes.

SUMMARY OF THE INVENTION

This invention consists of two types of line watchers, the first type is mounted in the court below the net and the second type is mounted outside the court all of them monitoring the outer area along the line as the human eye would. If the court is not supplied with enough light or when the competitions take place during the dark the below net LINE WATCHERS may be substituted with the out of court LINE WATCHERS which are more sensitive and even less expensive. The line watchers work in pairs except at the central serving line which requires only one watcher. A built in diaphragm limits the watched area to convenient sizes of a few feet width, according to the judgment needs along the lines. A battery of filters allows removal of the undesired effects of the ultra violet rays and very bright sunlight, meanwhile attenuating the whole spectrum of colors, except the ball color radiation, thus selecting each time, the image of the ball touching the watched area. A lens system with a concave mirror carries the ball image as a selected light spot to a terrestrial periscope, then thru an optical fibre glass cable, having matched connectors at both ends, to the pick up tube of a color T.V. camera, CAMCORD. Each time the ball color radiates through the channel, the pick up tube gives birth to electrical pulses of current, higher in amplitude than any other idle current produced by the players' legs, the background and others. Those pulses, selected by their amplitude produce a higher peak of current and go further to activate the channel; the idle pulses no longer activate the channel. Finally the passing pulses through the electronic channel produce the announcements according to the game rules. The watchers mounted out of the playing area are widely modified. The outside watchers do not need a periscope, no right prism, fibre glass cable or connectors, because they are located in the same unit with the pick up tube and the rest of the other gears.

The foregoing and other objects and features of this invention will be more fully understood from the following description of an illustrative embodiment thereof taken in conjunction with the accompanying drawings.

DETAILED DESCRIPTION

Figure 1:
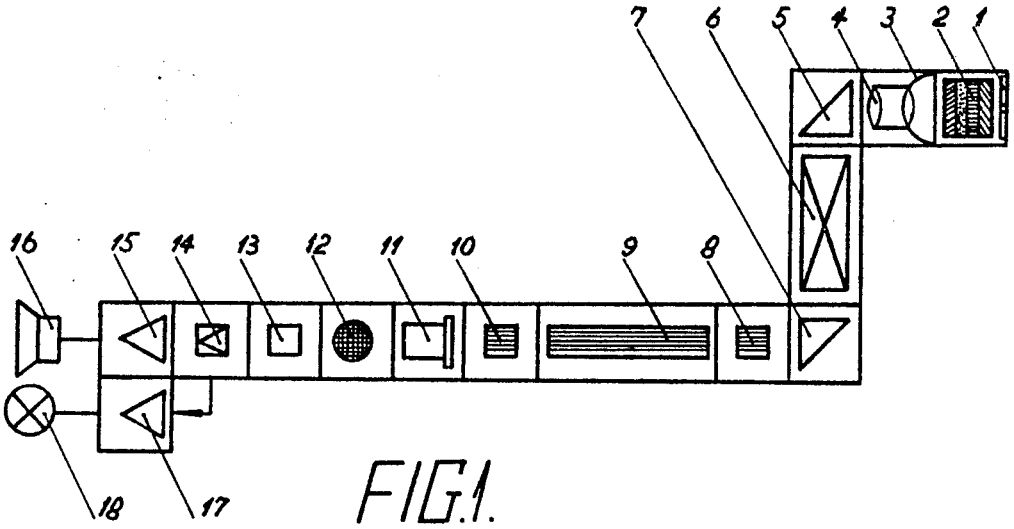
FIG. 1 shows, in schematic form, an opto electronic line watcher arranged in accordance with this invention, to be mounted below the net.

Referring to FIG. 1, the below net optical watchers consist of a diaphragm 1, a battery of filters 2, a concave mirror 3, a lens system 4, a right prism 5 and a terrestrial periscope lens system 6, without its two right prisms. The next items, a second right prism 7, a fibre glass optical connector 8, an optical fibre glass conductor 9 and a second fibre glass optical connector 10, are all part of the optical channel but all are mounted underground, in a block unit as it will be described next. A pick up tube 11, a sort of combined component is mounted below the net, underground together with components such as second right prism 7, optical connector 8, optical conductor 9 and optical connector 10, while the rest of a T.V. camera is mounted out of court with some other components of the system. The diaphragm 1 is set up first, then kept locked. Its small side ought to be mounted to the line side, the taller side being outside of the line. This diaphragm limits the watched area to a convenient size along the watched line, a few feet in width, as wide as the judging requests need and higher to the exterior. The nearby line side of the diaphragm is about two inches in height, and the opposite side of the diaphragm is several inches high. The position of this diaphragm can be changed as stated before. The battery of filters 2 is comprised of several filters for example color; conversion ones, color compensating, neutral density or interferential ones, according to the court characteristics, all of them related to the photograph shooting techniques. The mirror 3 helps in concentrating the spot of captured images. The lens group 4 focus the image on the next optical component, a right prism 5. This prism bends the image rays downward toward the lens system of a terrestrial periscope 6. The passed through image goes in a horizontal direction to a second right prism 7. Depending upon the type of the periscope the two right prisms 5 and 7 could be part of periscope. The optical connector 8 could be of any type, depending upon the availability. It is matched with the fibre glass optical conductor 9. At the end of 9 there is another optical connector 10, which leads the rays to the tube 11. When the ball touches the outer area watched by the line watchers the ball color manages to penetrate the optical channel through all its components. The ball, as a light radiator produces stronger light rays than the players legs, the background of the court and any other objects in between. The players' legs will never mask the ball because there are two line watchers for the same line and all the time one of them must be free. The ball color comes through highly emphasized as compared to all other rays. There is one condition, in order to benefit of a free of troubles judgment: the WHITE colour of players shoes or socks must be replaced by any of following colours: LIGHT BLUE, LIGHT GREEN, LIGHT BROWN, GREY, PINK or VIOLET. The information, in the form of colored light ray, goes through all components until it reaches the pick up tube 11, part of color T.V. camera, CAMCORD. Any time the ball touches the watched area the pick up tube receives the ball light ray radiated on its screen. In this way, each time the ball touches the watched area the pick up tube gives birth to electrical pulses of current, higher in amplitude than any other pulses due to the other images. Those pulses are weaker than the ball color ones and produce a sort of an idle current. The passing through pulses, due to ball color, are best amplified, in an electronic amplifier 12, part of the CAMCORD. We have to use the camera electronics from the pick up tube 11, to the video head 12. The rest of CAMCORD camera could be used for any other purposes. That includes the auto focusing system, the audio system and all taping machinery. Electronics component 13 allows selection of the pulses on the basis of their amplitude, with only high amplitude pulses passing through. Additional electronics component 14, which may be an electronic trigger, commands both video and audio signals. Low frequency sound generator 15 produces the audio announcements together with its power amplifier. The number of loud speakers in the sound terminal 16 is adjusted in accord with the characteristics of the tennis court. The power amplifier 17 for the video terminals 18, and the number of lamps are also adjusted according to the court characteristics. The additional electronics, not part of the CAMCORD including the terminals are common to one player's half court.

Figure 2:
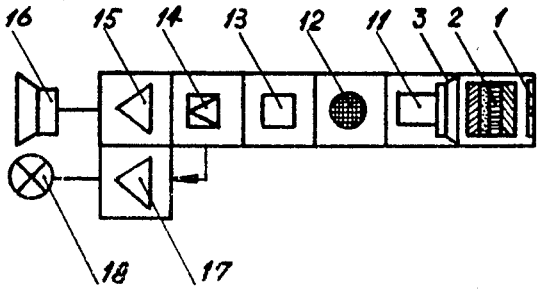
FIG. 2 shows, in schematic form, the opto electronic line watcher to be placed out of the playing area of the court, working combined with those mounted below net, in accordance with this invention.

The out of court watchers, in accordance with FIG. 2 are more simplified than the below net optical watchers. They do not need; lens group 4, right prism 5, terrestrial periscope 6, right prism 7, optical connector 8, optical conductor 9 and optical connector 10. The out of court watchers are comprised of the diaphragm 1, the battery of filters 2, the mirror 3, then the pick up tube connected directly with its lens system. The rest of the electronics are quite similar to those of below net line watchers.

Figure 3:
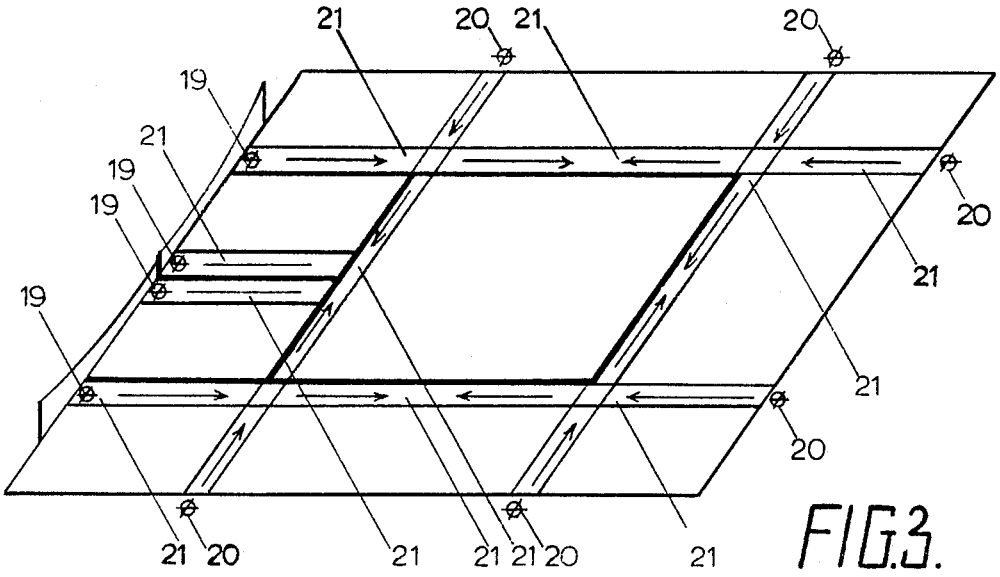
FIG. 3 shows where the opto electronical line watchers should be mounted.

FIG. 3 shows the positions of the line watchers and watched areas, identified as follows: (a) the below net line watchers 19, of which there are two for each of the four positions; (b) the out of court watchers 20, of which there are two for each of the six areas; and the watched areas 21.

Figure 4:
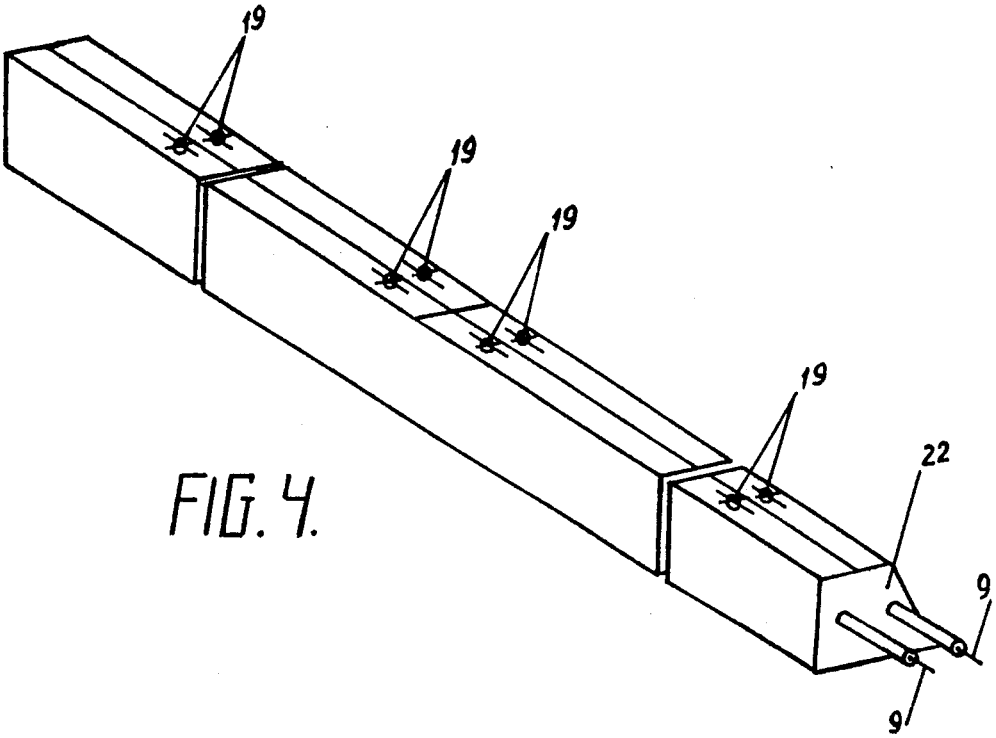
FIG. 4 depicts the below net unit and the positions of the watchers.

FIG. 4, shows by way of example an embodiment of the below net unit carrying the watchers. The unit body 22 may be made of any suitable material. The holes 19 for installing the line watchers in the body 22, are covered by screw taps, when the court is not in use. The unit 22 is inserted in the court structure, exactly below the net, half in one side, the other half in the other side, so the net touches the imaginary median line of the unit body.

Figure 5:
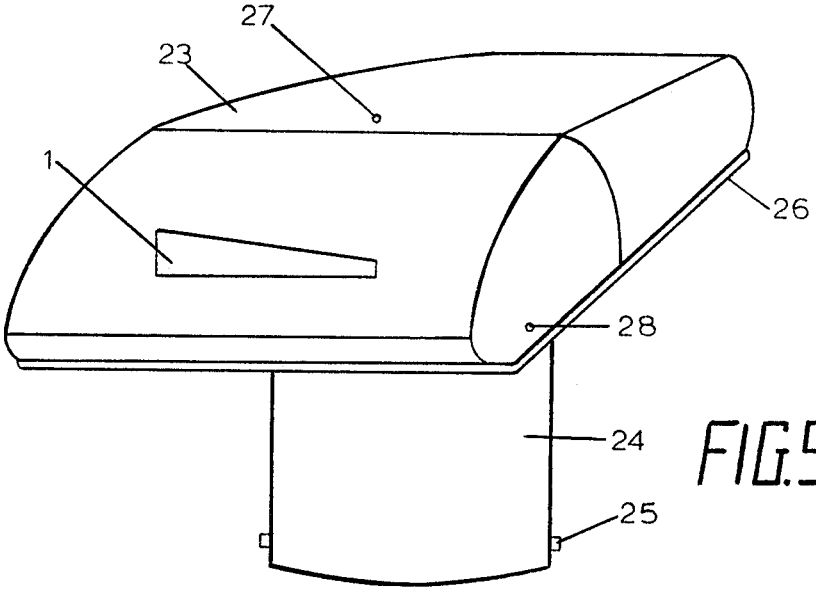
FIG. 5 shows the below net optical line watchers, a general view, in accordance with this invention.

FIG. 5 shows, in general view a below net watcher 19, including its upper part 23, its bottom 24, two locking pegs 25 and a rubber sheet 26 to assure a tight assembling. Two holes 27 and 28 permit the adjustment of the two screws of diaphragm 1, when its position is first set along the line. The body of the below net line watchers, as can be seen in FIG. 5 is made with a curved surface, with aerodynamic shape, to avoid any hurting impact in case some of players reach that area. The out of court line watchers are mounted on heavy weight bodies, to assure a stable position replacing the lines.

Although a specific embodiment of this invention has been shown and described, it will be understood that various modifications made be made without departing from the spirit of this invention.

We claim:

1. An optoelectronic lawn tennis linesman system, comprising:

(i) twenty optical line watchers including eight below net line watchers and twelve out-of-court line watchers, for arrangement on a tennis court in an array comprising two below net line watcher at each central serving line, and two opposing line watchers for watching each of remaining lines, including a below net line watcher and an out-of-court line watcher monitoring each sideline, and opposing out-of-court line watchers monitoring each service line and baseline; and (ii) electronic means cooperative with said optical line watchers for audio announcement and/or visual display of line call events in response to detection by said optical line watchers of the color of a tennis ball in line areas monitored by said line watchers;

wherein said below net line watchers comprise:

(a) a diaphragm, limiting the watched area along the line monitored by the below net line watcher;

(b) a battery of filters which selectively attenuates optical signals received from sources other than said tennis ball and which allows a color image attributable to said tennis ball to pass therethrough;

(c) a concentrating concave mirror, which concentrates the image passed through said battery of filters;

(d) a lens system for focusing the image concentrated by said concentrating concave mirror;

(e) a right prism which receives the image focused by said lens system and downwardly redirects the focused image;

(f) a terrestrial periscope lens system for passing the downwardly redirected focused image from the first right prism therethrough;

(g) a second right prism which receives the image passed through said terresterial periscope lens system and redirects it in a horizontal direction;

(h) a first optical connector, matched to said second right prism;

(i) a glass fiber optical conductor, matched to said first optical connector; and (j) a second optical connector matched to said glass fiber optical conductor.

2. A system according to claim 1, wherein said electronic means comprise audio output means for generating audio announcements of said line call events.

3. A system according to claim 1, wherein said electronic means comprise video display means for visually displaying a said tennis ball in line areas monitored by said optical line watchers.

4. A system according to claim 1, wherein said electronic means comprise a CAMCORD device.

5. A system according to claim 1, wherein the out-of-court optical line watchers comprise:

(A) a diaphragm, limiting the watched area monitored by the out-of-court optical line watcher;

(B) a battery of filters which selectively attenuates optical signals received from sources other than said tennis ball and which allows a color image attributable to said tennis ball to pass therethrough; and (C) a concentrating concave mirror, which concentrates the image passed through said battery of filters.

6. A system according to claim 5, further comprising (D) a lens system for focusing the image concentrated by the concentrating concave mirror (C).

7. A system according to claim 6, wherein said lens system (D) is part of a CAMCORD device.

8. A system according to claim 1, wherein said second optical connector is coupled with a CAMCORD device.

9. An optoelectronic lawn tennis linesman system, based upon optical line watchers in combination with electronic means cooperative therewith for audio announcement and/or visual display of line call events in response to sensing of a ball color image associated with the presence of a tennis ball in line areas monitored by said optical line watchers, said optical line watchers including below net line watchers which comprise:

(a) a diaphragm, limiting the watched area along the line monitored by the below net line watcher;

(b) a battery of filters which selectively attenuates optical signals received from sources other than said tennis ball and which allows the ball color image attributable to said tennis ball to pass therethrough;

(c) a concentrating concave mirror, which concentrates the image passed through said battery of filters;

(d) a lens system for focusing the image concentrated by said concentrating concave mirror;

(e) a right prism which receives the image focused by said lens system and downwardly redirects the focused image;

(f) a terrestrial periscope lens system for passing the downwardly redirected focused image from the first right prism therethrough;

(g) a second right prism which receives the image passed through said terresterial periscope lens system and redirects it in a horizontal direction;

(h) a first optical connector, matched to said second right prism;

(i) a glass fiber optical conductor, matched to said first optical connector; and (j) a second optical connector matched to said glass fiber optical conductor.

10. A system according to claim 9, wherein said electronic means (i) generate a high amplitude signal in response to said ball color image and relative to sensing by said system of images not including said ball color image, and (ii) process said signal to produce said audio announcement and/or visual display of line call events.

11. A system according to claim 9, wherein said electronic means comprise a CAMCORD device.

* * * * *

UNITED STATES PATENT AND TRADEMARK OFFICE

CERTIFICATE OF CORRECTION

PATENT NO. : 4,866,414

DATED : September 12, 1989

INVENTOR(S) : Sever Diaconu et al

It is certified that error appears in the above-identified patent and that said Letters Patent is hereby corrected as shown below:

Column 1, line 12, "are" should read --area,--.

Column 1, line 24, "slippery, that was due" should read --slippery due to--.

Column 1, line 24, "Our system is... should begin a paragraph.

Column 3, line 46, delete the semi-colon after "need".

Signed and Sealed this

Eleventh Day of September, 1990

*Attest:*

HARRY F. MANBECK, JR.

*Attesting Officer*

*Commissioner of Patents and Trademarks*